United States Patent [19]

Anderson

[11] 4,381,246

[45] Apr. 26, 1983

[54] NON-FOGGING PREMOISTENED WIPER

[75] Inventor: Ralph L. Anderson, Boothwyn, Pa.

[73] Assignee: Scott Paper Company, Philadelphia, Pa.

[21] Appl. No.: 306,006

[22] Filed: Sep. 28, 1981

[51] Int. Cl.[3] ..... C11D 17/00

[52] U.S. Cl. ..... 252/91; 252/89.1; 252/70; 252/133; 252/134; 252/DIG. 10; 252/174; 252/173; 15/104.93; 15/104.94; 15/209 R; 15/256.5; 106/13; 428/288; 428/289; 428/696; 428/913

[58] Field of Search ..... 252/DIG. 10, 89.1, 91, 252/70, 134, 173, 174, 133; 15/104.93, 104.94, 209 R, 256.5; 106/13; 428/289, 288, 696, 913

[56] References Cited

U.S. PATENT DOCUMENTS

| | | | |
|---|---|---|---|
| 2,179,004 | 9/1936 | Bishop | 252/DIG. 10 |
| 2,447,297 | 1/1942 | Wegst | 252/DIG. 10 |
| 2,735,721 | 3/1950 | Rafferty | 15/104.94 |
| 3,177,055 | 4/1965 | Ruckle | 134/6 |
| 3,477,084 | 9/1967 | Thomas | 15/104.93 |
| 3,981,741 | 9/1976 | Iino | 134/6 |
| 4,069,066 | 1/1978 | Hindle et al. | 134/6 |
| 4,203,857 | 5/1980 | Dugan | 15/104.93 |

*Primary Examiner*—John E. Kittle
*Assistant Examiner*—Hoa Van Le
*Attorney, Agent, or Firm*—John A. Weygandt; John W. Kane, Jr.

[57] ABSTRACT

Fibrous web adapted for wiping purposes bonded with a rubber latex and impregnated with a cleaning lotion containing zinc chloride.

3 Claims, No Drawings

NON-FOGGING PREMOISTENED WIPER

BACKGROUND OF THE INVENTION

1. Field of the Invention

This invention relates to a fibrous web impregnated with a lotion for household cleaning purposes. More particularly it relates to a fibrous web bonded with a rubber latex and wherein the lotion contains a metal salt as an anti-fogging ingredient.

2. Description of the Prior Art

Fibrous cleaning materials comprising an impregnated fibrous web bonded with a latex material is known to be useful for household cleaning. In particular, a fibrous web impregnated with a rubber latex is known to have exceptional utility for this purpose. Such a product is described in U.S. Pat. No. 3,981,741 granted Sept. 21, 1976 to lino. One of the main technical problems with the use of such a wiper has been the formation of a "fog" on the surface of articles cleaned with such a product. The fog is especially noticeable on surfaces such as glass and chrome. This fog is believed to consist of residues extracted from binder material on the web. The inventor in the aforementioned U.S. Pat. No. 3,981,741 apparently deals with this problem by including a polar high molecular weight substance such as polyvinyl acetate or acrylonitrile-butadiene copolymer. According to said patent disclosure the particles of the rubber and those of the polar high molecular weight substance presumably prevent each other from forming films, with the result that the particles adhere to the fibrous material individually.

SUMMARY OF THE INVENTION

In accordance with the present invention, a fibrous web adapted for wiping purposes is bonded with a rubber latex selected from the group consisting of natural rubber latex, butadiene rubber latex and styrene-butadiene rubber latex and impregnated with a cleaning lotion containing zinc chloride. Without wishing to be bound by theory, the present inventor believes that the zinc chloride insolubilizes the low molecular weight molecules present on the web that are not cross linked so that they do not dissolve into the lotion and form an unsightly residue when applied to glass, chrome, and like surfaces.

Since zinc chloride is a deliquescent crystal, when it is left behind on a mirror or like object, it will absorb moisture from the air, remain transparent and serve as an extremely effective anti-fogging device. Zinc chloride also has an insolublizing effect which serves to increase the wet strength of the web.

DESCRIPTION OF THE PREFERRED EMBODIMENTS

The rubber used in the present invention is selected from the group consisting of natural rubber, polybutadiene rubber, and styrene butadiene rubber. Of these, styrene butadiene is preferred and most particularly a styrene butadiene latex of high styrene content. The latex may be carboxylated and may contain N-methylolacrylamide groups, or other means of highly crosslinking the polymer.

The fibrous web to be bonded with the rubber latex in accordance with this invention may be comprised of natural or synthetic fibers and may consist of any nonwoven fabric woven, knitted or netted fabric, paper and the like. A nonwoven fabric predominately of short (paper length) fibers is preferred for its low cost and disposability.

The cleaning property of the fibrous web is enhanced by impregnation with a lotion which contains, for example, water, a glycol, surfactant, film former, preservative and fragrance. In accordance with the present discovery, if the lotion further includes 0.2 to 1% by weight zinc chloride the problem of fogging is eliminated. The exact mechanism for this improvement is not understood. Other metal salts tried by the present inventor have not been found to have the suitability of the zinc chloride. Aluminum chloride, while it appeared to insolubilize the low molecular weight molecules of the rubber latex, left behind crystals on the surface which was wiped. Other metal chlorides, namely cobalt, strontium and manganese yielded only a slight improvement on the fogging problem. Nitrates of magnesium, aluminum, nickel and cadmium gave good improvement but are not suitable for use on the human skin.

The composition of the cleaning lotion is adjusted to suit the particular cleaning object or purpose. In general it comprises the following ingredients:

Surface active agents are added to increase the effect of removing dirt, especially grease, from the surface to be cleaned. The surfactant should be non-ionic so as not to interfere with the action of the zinc chloride.

Wetting agents, such as polyvinyl alcohol and carboxymethyl cellulose may also be included for enhancing the cleaning effect of the wiper.

Water soluble, non-volatile solvents which act to dissolve oily dirt are included for an improved cleaning effect. Examples include polyethylene glycol, glycerin, polypropylene glycol, ethylene glycol monobutyl ether and like polyhydricalcohols. Such solvents should, of course, not be a solvent for the rubber latex.

Fragrances may be included for their esthetic value and a preservative to stabilize and increase the shelf life of the lotion.

In accordance with the present invention, a rubber latex is applied to a fibrous web by conventional methods, for example, by dipping, by roller coating or by spraying. As will be understood by one of ordinary skill in the art to which the present invention pertains the amount of latex applied to the fibrous web is sufficient to provide the strength required by the cleaning purpose. Thereafter the web containing the rubber latex is dried in order to achieve the bonding effect.

Subsequently the bonded web is impregnated with the cleaning lotion again by conventional means to provide the desired level of addition of the cleaning lotion.

The principles, features and advantages of the present invention will be further understood upon consideration of the following specific example; wherein percentages are all by weight:

EXAMPLE

An air laid web consisting of 90% Northern Pine pulp and 10% polyester fibers of 1⅝" length was impregnated by dipping it in a binder emulsion comprising a high styrene butadiene latex containing an urea formaldehyde cross linking resin. The binder was implied at the rate of 9% solids by weight of the web. Thereafter a lotion was applied at the rate of 300% by weight of the fibrous web. The cleaning lotion comprised ethylene glycol monobutyl ether 7%, propylene glycol 7%, surfactants 0.7%, fragrance 0.035%, preservative 0.08%, zinc chloride 0.5% and distilled water 84.685%.

In order to evaluate the antifogging effect of the zinc chloride, optical reflectance tests were carred out to measure the amount of haze and visual contamination on the test surface which consisted of a mirror. The optical reflectance tests were conducted as follows:

A mirror (one foot square) was cleaned with soap and water, then rinsed and wiped dry with a clean towel with good wipe dry properties and no latex additives or soluble materials. The wipers were lotionized with 300% by weight of lotion. The mirror was wiped evenly by one pass at a time until the whole mirror had been wiped. Then the procedure was repeated in the cross-direction. The mirror was allowed to dry at 75° F. and 50% relative humidity for one hour. After the drying step, the light which was transmitted back to an incident light source was measured by an optical densicron attached to a motorized traverse rail which passed across the mirror. The signal was connected to a recorder and the change (compared to measurements on the clean mirror) in transmitted or reflected light was observed. This yielded a measure of light scattered by a residue film or haze.

The results were as follows:

| Sample Description | Percent Reflectance |
|---|---|
| Clean Mirror | 93.6 |

-continued

| Sample Description | Percent Reflectance |
|---|---|
| Control Sample Wipe | 84.9 |
| Sample with 0.5% Zinc chloride | 93.9 |

The control sample wipe was identical to the wipe described in the Example except for the omission of zinc chloride. The reduction in transmittance represented by the control sample wipe containing no zinc chloride in the lotion would be a commercially unacceptable result. As may be seen from the above, the inclusion of zinc chloride improves the performance of the wiper to the point where the mirror is wiped clean and restored to the original or better transmittance.

Although the invention has been described with reference to a preferred embodiment thereof, it is to be understood that various changes may be resorted to by one skilled in the art without departing from the spirit and scope of the invention as defined by the appended claims.

What is claimed is:

1. A fibrous web for cleaning and rendering surfaces non-fogging comprising a fibrous web bonded with a latex selected from the group consisting of natural rubber, butadiene rubber and styrene-butadiene rubber and impregnated with an aqueous cleaning solution comprising 0.2–1.0% by weight zinc chloride.

2. The web in accordance with claim 1 wherein the latex is a styrene-butadiene rubber latex.

3. The web in accordance with claim 2 wherein the latex is a high styrene styrene-butadiene rubber latex.

* * * * *